US007040394B2

(12) United States Patent
Bailey et al.

(10) Patent No.: US 7,040,394 B2
(45) Date of Patent: May 9, 2006

(54) ACTIVE/PASSIVE SEAL ROTATING CONTROL HEAD

(75) Inventors: Thomas F. Bailey, Houston, TX (US); James Chambers, Hackett, AR (US); Don M. Hannegan, Fort Smith, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/285,336

(22) Filed: Oct. 31, 2002

(65) Prior Publication Data

US 2004/0084220 A1 May 6, 2004

(51) Int. Cl.
*E21B 33/068* (2006.01)

(52) U.S. Cl. ..... 166/84.4; 166/84.2; 277/333

(58) Field of Classification Search ..... 166/84.1, 166/84.2, 84.3, 84.4; 175/195; 277/332, 277/333

See application file for complete search history.

(56) References Cited

U.S. PATENT DOCUMENTS

| | | | | |
|---|---|---|---|---|
| 3,583,480 | A * | 6/1971 | Regan | 166/352 |
| 4,143,881 | A | 3/1979 | Bunting | |
| 4,313,054 | A * | 1/1982 | Martini | 235/78 R |
| 4,440,232 | A * | 4/1984 | LeMoine | 166/373 |
| 4,448,255 | A * | 5/1984 | Shaffer et al. | 166/387 |
| 4,509,405 | A * | 4/1985 | Bates | 91/420 |
| 4,531,580 | A * | 7/1985 | Jones | 166/84.3 |
| 5,178,215 | A | 1/1993 | Yenulis et al. | 166/80 |
| 5,251,869 | A | 10/1993 | Mason | |
| 5,348,107 | A * | 9/1994 | Bailey et al. | 175/162 |
| 5,662,181 | A | 9/1997 | Williams et al. | 175/195 |
| 5,848,643 | A | 12/1998 | Carbaugh et al. | 166/85.4 |
| 6,109,348 | A * | 8/2000 | Caraway | 166/84.3 |
| 6,129,152 | A | 10/2000 | Hosie et al. | 166/384 |
| 6,244,359 | B1 | 6/2001 | Bridges et al. | |
| 6,354,385 | B1 | 3/2002 | Ford et al. | |
| 6,470,975 | B1 * | 10/2002 | Bourgoyne et al. | 175/57 |
| 6,554,016 | B1 * | 4/2003 | Kinder | 137/12 |
| 2002/0070014 | A1 | 6/2002 | Kinder | |
| 2003/0102136 | A1 * | 6/2003 | Nelson et al. | 166/387 |

OTHER PUBLICATIONS

U.K. Search Report, Application No. GB 0325423.2, dated Feb. 2, 2004.

* cited by examiner

*Primary Examiner*—David Bagnell
*Assistant Examiner*—Daniel P. Stephenson
(74) *Attorney, Agent, or Firm*—Patterson & Sheridan, LLP

(57) ABSTRACT

The present invention generally relates to an apparatus and method for sealing a tubular string. In one aspect, a drilling system is provided. The drilling system includes a rotating control head for sealing the tubular string while permitting axial movement of the string relative to the rotating control head. The drilling system also includes an actuating fluid for actuating the rotating control head and maintaining a pressure differential between a fluid pressure in the rotating control head and a wellbore pressure. Additionally, the drilling system includes a cooling medium for passing through the rotating control head. In another aspect, a rotating control head is provided. In yet another aspect, a method for sealing a tubular in a rotating control head is provided.

49 Claims, 8 Drawing Sheets

280
285
265
205
270

205
265
200
230
P2
P1

275
270
255
235
240
225
220
210
215

FIG.3B
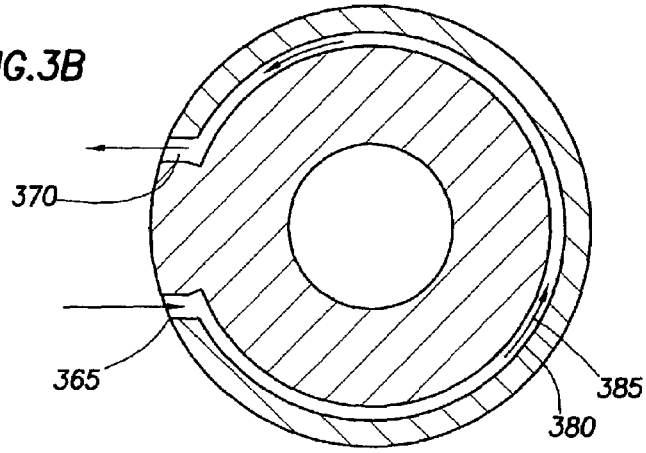
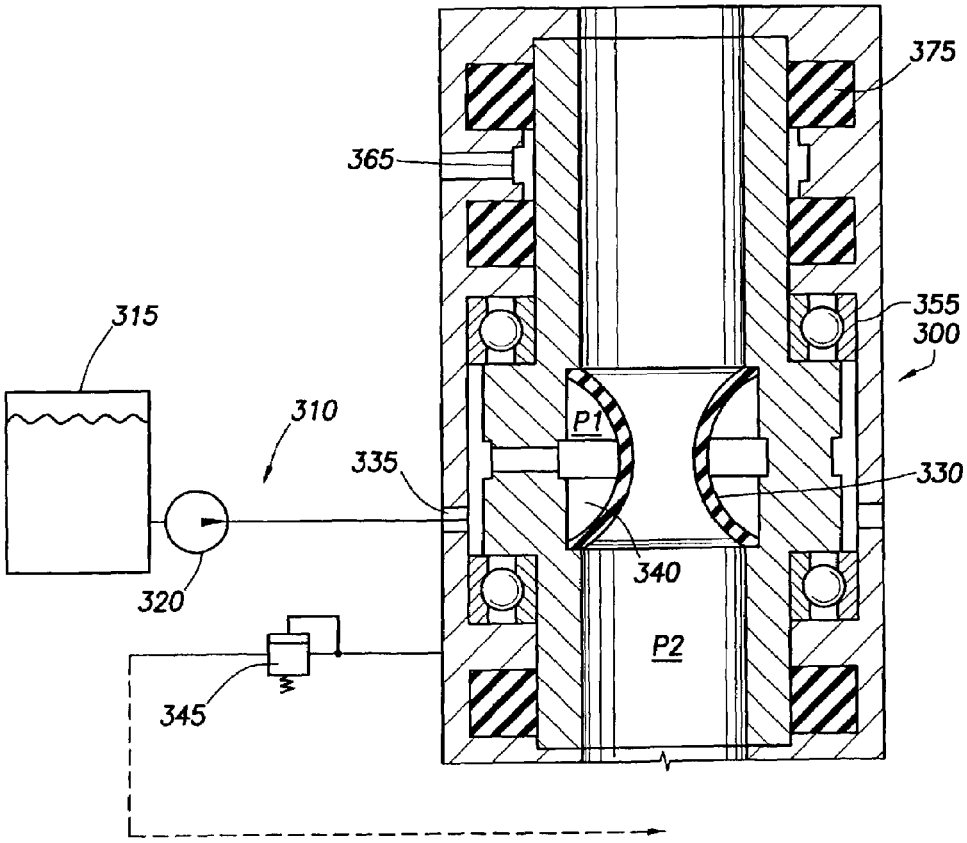
FIG.3A

FIG.4B
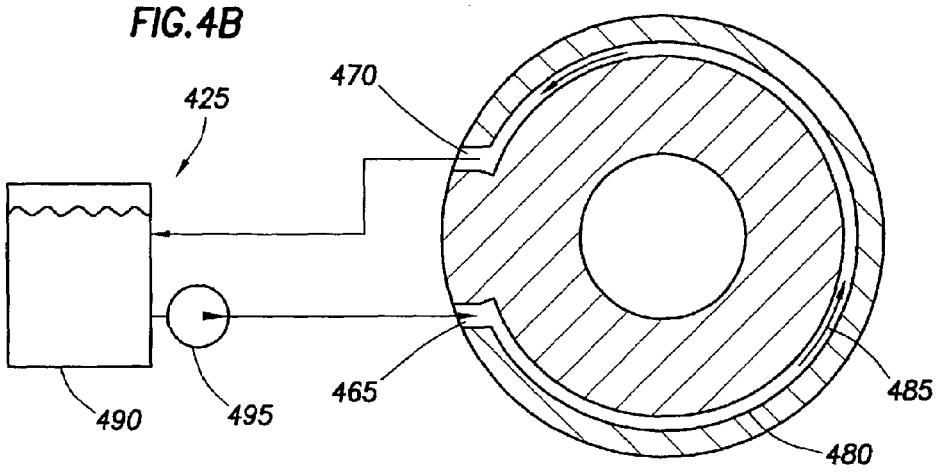
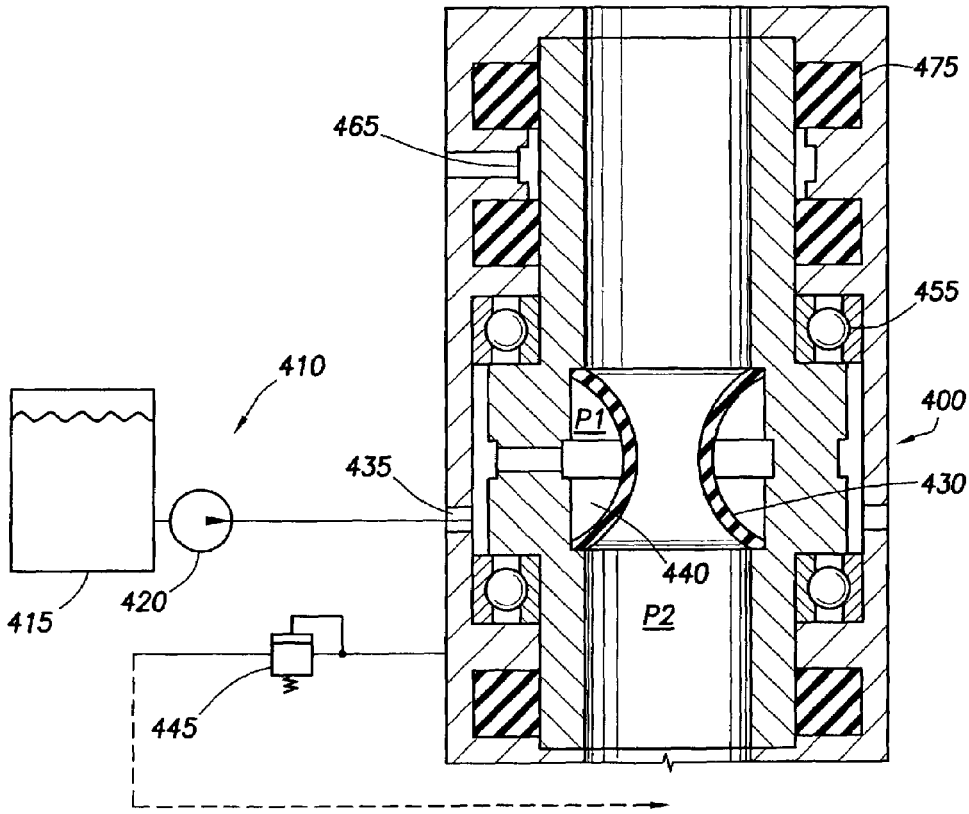
FIG.4A

FIG.5B
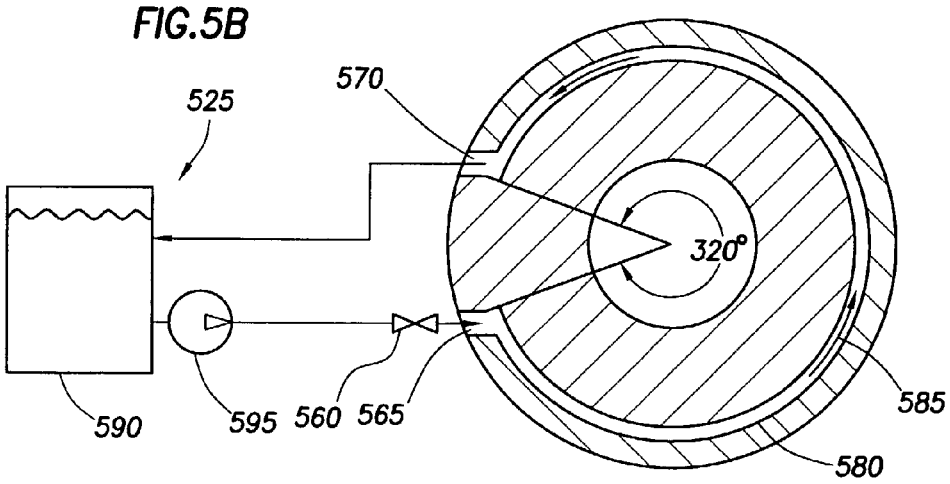
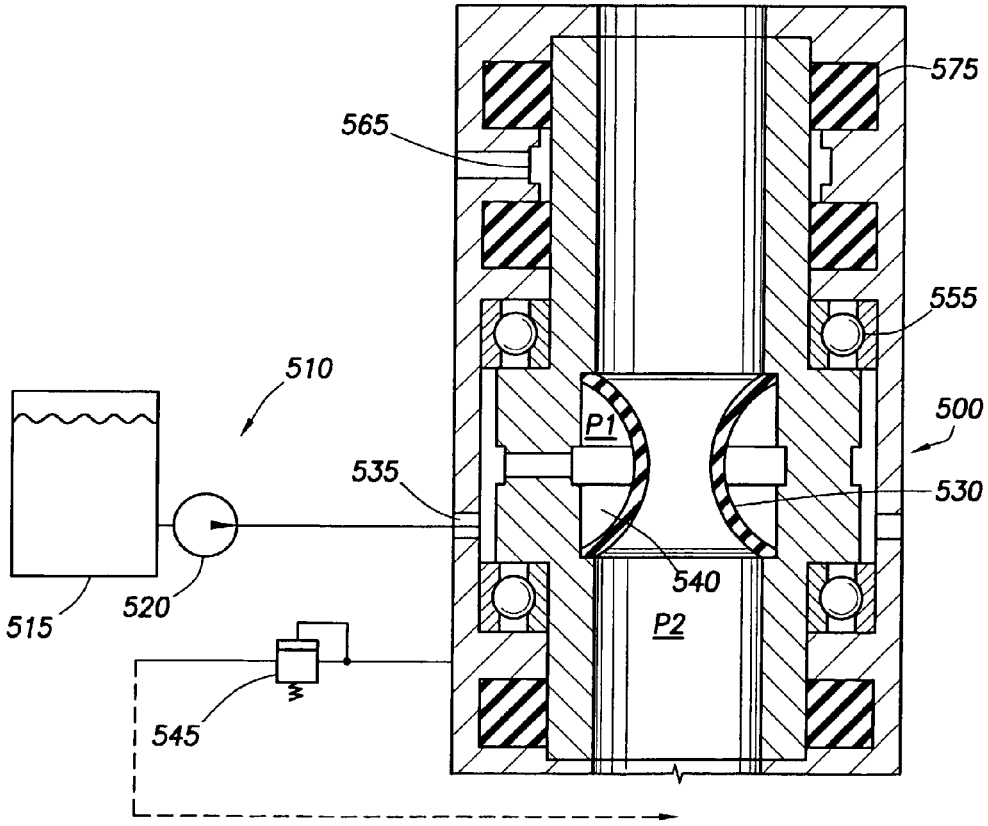
FIG.5A

ACTIVE/PASSIVE SEAL ROTATING CONTROL HEAD

BACKGROUND OF THE INVENTION

1. Field of the Invention

Embodiments of the present invention relate generally to a method and an apparatus for a drilling operation. More particularly, the invention relates to a rotating control head. Still more particularly, the invention relates to the actuation and cooling of a rotating control head.

2. Description of the Related Art

Drilling a wellbore for hydrocarbons requires significant expenditures of manpower and equipment. Thus, constant advances are being sought to reduce any downtime of equipment and expedite any repairs that become necessary. Rotating equipment is particularly prone to maintenance as the drilling environment produces abrasive cuttings detrimental to the longevity of rotating seals, bearings, and packing elements.

In a typical drilling operation, a drill bit is attached to a drill pipe. Thereafter, a drive unit rotates the drill pipe through a drive member, referred to as a kelly as the drill pipe and drill bit are urged downward to form the wellbore. In some arrangements, a kelly is not used, thereby allowing the drive unit to attach directly to the drill pipe. The length of the wellbore is determined by the location of the hydrocarbon formations. In many instances, the formations produce gas or fluid pressure that may be a hazard to the drilling crew and equipment unless properly controlled.

Several components are used to control the gas or fluid pressure. Typically, one or more blow out preventers (BOP) are mounted to the well forming a BOP stack to seal the mouth of the well. Additionally, an annular BOP is used to selectively seal the lower portions of the well from a tubular body that allows the discharge of mud through the outflow line. In many instances, a conventional rotating control head, also referred to as a rotating blow out preventor, is mounted above the BOP stack. An internal portion of the conventional rotating control head is designed to seal and rotate with the drill pipe. The internal portion typically includes an internal sealing element mounted on a plurality of bearings.

The internal sealing element may consist of both a passive seal arrangement and an active seal arrangement. The active seal arrangement is hydraulically activated. Generally, a hydraulic circuit provides hydraulic fluid to the active seal rotating control head. The hydraulic circuit typically includes a reservoir containing a supply of hydraulic fluid and a pump to communicate the hydraulic fluid from the reservoir to the rotating control head. As the hydraulic fluid enters the rotating control head, a pressure is created to energize the active seal arrangement. Preferably, the pressure in the active seal arrangement is maintained at a greater pressure than the wellbore pressure. Typically, the hydraulic circuit receives input from the wellbore and supplies hydraulic fluid to the active seal arrangement to maintain the pressure differential. However, the hydraulic circuit in the conventional active seal rotating control head has a less than desirable response time to rapidly changing wellbore pressure.

During the drilling operation, the drill pipe is axially and slidably forced through the rotating control head. The axial movement of the drill pipe causes wear and tear on the bearing and seal assembly and subsequently requires repair. Typically, the drill pipe or a portion thereof is pulled from the well and a crew goes below the drilling platform to manually release the bearing and seal assembly in the rotating control head. Thereafter, an air tugger in combination with a tool joint on the drill string are typically used to lift the bearing and seal assembly from the rotating control head. The bearing and seal assembly is replaced or reworked and thereafter the crew goes below the drilling platform to reattach the bearing and seal assembly into the rotating control head and operation is resumed. The process is time consuming and can be dangerous.

Additionally, the thrust generated by the wellbore fluid pressure and the radial forces on the bearing assembly causes a substantial amount of heat to build in the conventional rotating control head. The heat causes the seals and bearings to wear and subsequently require repair. The conventional rotating control head typically includes a cooling system that circulates oil through the seals and bearings to remove the heat. However, the oil based cooling system may be very expensive to implement and maintain.

There is a need therefore, for a cost-effective cooling system for a rotating control head. There is a further need therefore for a cooling system in a rotating control head that can be easily implemented and maintained. There is a further need for an effective hydraulic circuit to actuate the active sealing arrangement in a rotating control head and to maintain the proper pressure differential between the fluid pressure in the rotating control head and the wellbore pressure. There is yet a further need for an improved rotating control head.

SUMMARY OF THE INVENTION

The present invention generally relates to an apparatus and method for sealing a tubular string. In one aspect, a drilling system is provided. The drilling system includes a rotating control head for sealing the tubular string while permitting axial movement of the string relative to the rotating control head. The drilling system also includes an actuating fluid for actuating the rotating control head and maintaining a pressure differential between a fluid pressure in the rotating control head and a wellbore pressure. Additionally, the drilling system includes a cooling medium for passing through the rotating control head.

In another aspect, a rotating control head is provided. The rotating control head includes a sealing member for sealing a tubular string while permitting axial movement of the string relative to the rotating control head. The rotating control head further includes an actuating fluid for actuating the rotating control head and maintaining a pressure differential between a fluid pressure in the rotating control head and a wellbore pressure.

In another aspect, a method for sealing a tubular in a rotating control head is provided. The method includes supplying fluid to the rotating control head and activating a seal arrangement to seal around the tubular. The method further includes passing a cooling medium through the rotating control head and maintaining a pressure differential between a fluid pressure in the rotating control head and a wellbore pressure.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3A illustrates a rotating control head cooled by flow a gas.

FIG. 3B illustrates a schematic view of the gas in a substantially circular passageway.

FIG. 4A illustrates a rotating control head cooled by a fluid mixture.

FIG. 4B illustrates a schematic view of the fluid mixture circulating in a substantially circular passageway.

FIG. 5A illustrates the rotating control head cooled by a refrigerant.

FIG. 5B illustrates a schematic view of the refrigerant circulating in a substantially circular passageway.

DETAILED DESCRIPTION OF THE PREFERRED EMBODIMENT

Figure 1:
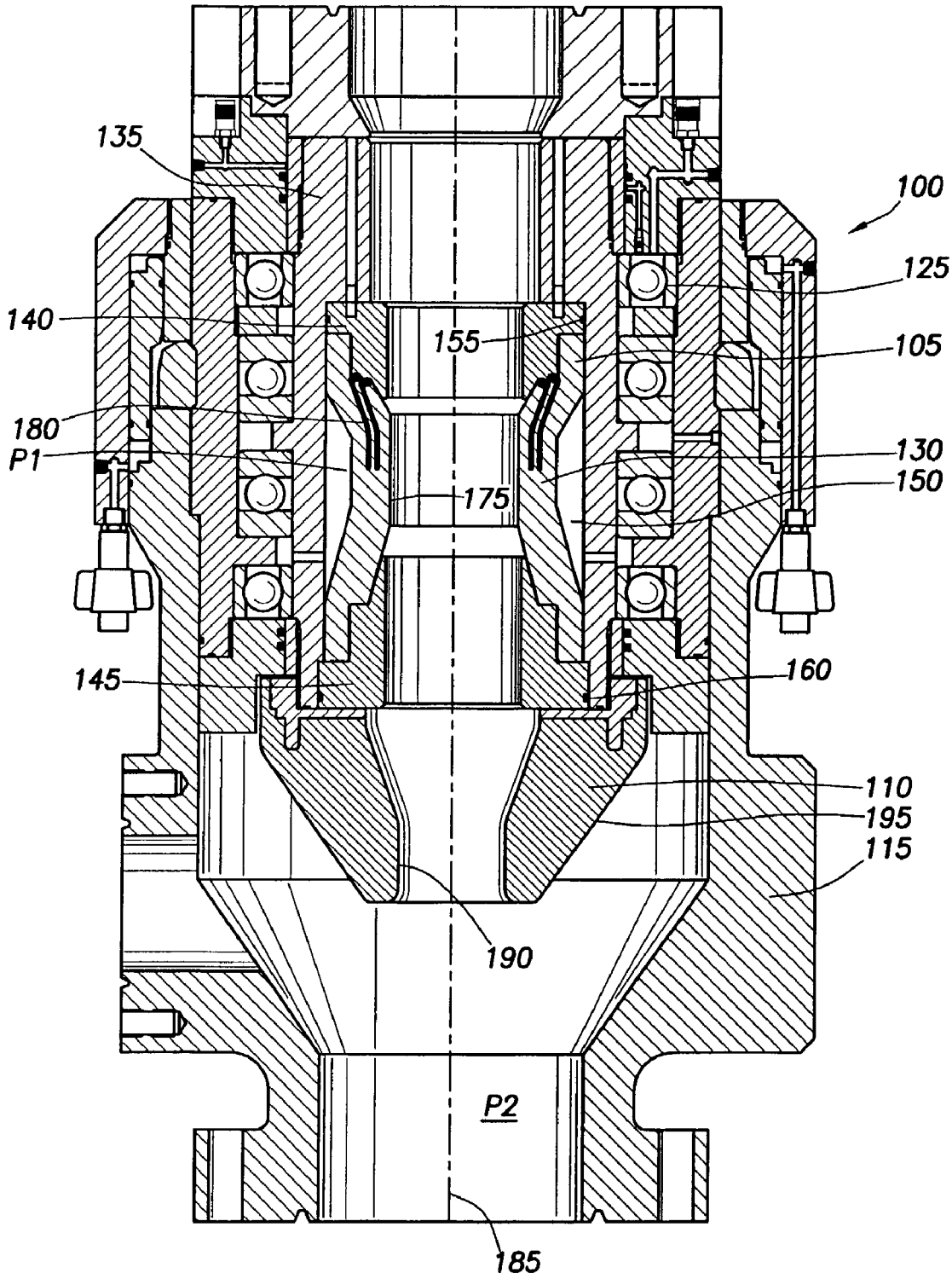
FIG. 1 is a cross-sectional view illustrating a rotating control head in accord with the present invention.

Generally, the present invention relates to a rotating control head for use with a drilling rig. Typically, an internal portion of the rotating control head is designed to seal around a rotating tubular string and rotate with the tubular string by use of an internal sealing element, and rotating bearings. Additionally, the internal portion of the rotating control head permits the tubular string to move axially and slidably through the rotating control head on the drilling rig. FIG. 1 generally describes the rotating control head and FIGS. 2–6 illustrate various methods of cooling and actuating the rotating control head. Additionally, FIGS. 7 and 8 illustrate alternate embodiments of the rotating control head.

FIG. 1 is a cross-sectional view illustrating the rotating control head 100 in accord with the present invention. The rotating control head 100 preferably includes an active seal assembly 105 and a passive seal assembly 110. Each seal assembly 105, 110 includes components that rotate with respect to a housing 115. The components that rotate in the rotating control head are mounted for rotation on a plurality of bearings 125.

As depicted, the active seal assembly 105 includes a bladder support housing 135 mounted on the plurality of bearings 125. The bladder support housing 135 is used to mount bladder 130. Under hydraulic pressure, as discussed below, bladder 130 moves radially inward to seal around a tubular such as a drilling pipe (not shown). In this manner, bladder 130 can expand to seal off borehole 185 through the rotating control head 100.

As illustrated in FIG. 1, upper and lower caps 140, 145, respectfully, fit over the upper and lower end of the bladder 130 to secure the bladder 130 within the bladder support housing 135. Typically, the upper and lower caps 140, 145 are secured in position by a setscrew (not shown). Upper and lower seals 155, 160, respectfully, seal off chamber 150 that is preferably defined radially outwardly of bladder 130 and radially inwardly of bladder support housing 135.

Generally, fluid is supplied to the chamber 150 under a controlled pressure to energize the bladder 130. The hydraulic control (not shown) will be illustrated and discussed in FIGS. 2–6. Essentially, the hydraulic control maintains and monitors hydraulic pressure within pressure chamber 150. Hydraulic pressure P1 is preferably maintained by the hydraulic control between 0 to 200 psi above a wellbore pressure P2. The bladder 130 is constructed from flexible material allowing bladder surface 175 to press against the tubular at approximately the same pressure as the hydraulic pressure P1. Due to the flexibility of the bladder, it also may conveniently seal around irregular shaped tubular string such as a hexagonal kelly. In this respect, the hydraulic control maintains the differential pressure between the pressure chamber 150 at pressure P1 and wellbore pressure P2. Additionally, the active seal assembly 105 includes support fingers 180 to provide support to the bladder 130 at the most stressful area of the seal between the fluid pressure P1 and the ambient pressure.

The hydraulic control may be used to de-energize the bladder 130 and allow the active seal assembly 105 to release the seal around the tubular. Generally, fluid in the chamber 150 is drained into a hydraulic reservoir (not shown), thereby reducing the pressure P1. Subsequently, the bladder surface 175 loses contact with the tubular as the bladder 130 becomes de-energized and moves radially outward. In this manner, the seal around the tubular is released allowing the tubular to be removed from the rotating control head 100.

In the embodiment shown in FIG. 1, the passive seal assembly 110 is disposed below the active seal assembly 105. The passive seal assembly 110 is operatively attached to the bladder support housing 135, thereby allowing the passive seal assembly 110 to rotate with the active seal assembly 105. Fluid is not required to operate the passive seal assembly 110 but rather it utilizes pressure P2 to create a seal around the tubular. The passive seal assembly 110 is constructed and arranged in an axially downward conical shape, thereby allowing the pressure P2 to act against a tapered surface 195 to close the passive seal assembly 110 around the tubular. Additionally, the passive seal assembly 110 includes an inner diameter 190 smaller than the outer diameter of the tubular to allow an interference fit between the tubular and the passive seal assembly 110.

Figures 2A, 2B:
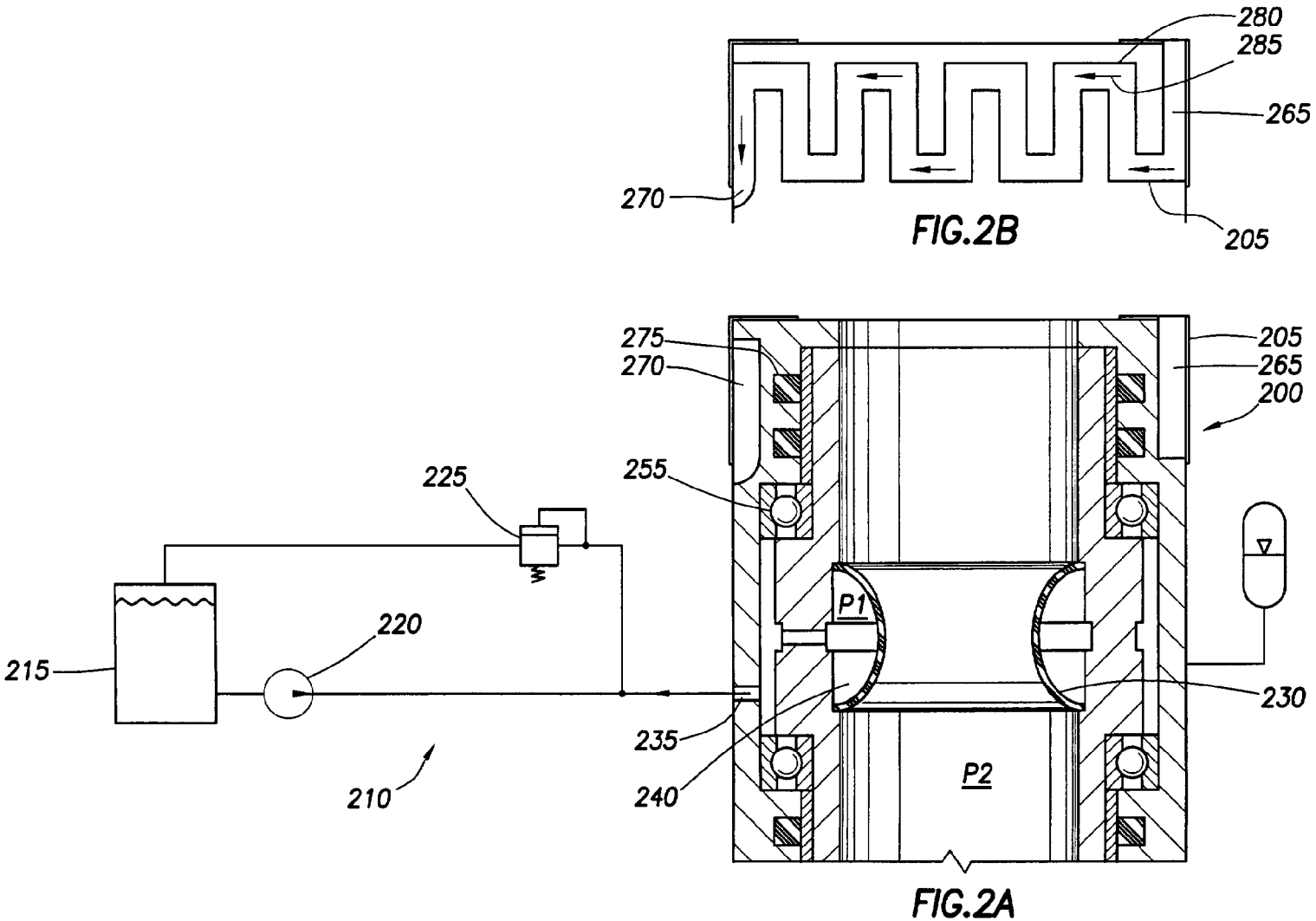
FIG. 2A illustrates a rotating control head cooled by a heat exchanger.
FIG. 2B illustrates a schematic view of the heat exchanger.

FIG. 2A illustrates a rotating control head 200 cooled by heat exchanger 205. As shown, the rotating control head 200 is depicted generally to illustrate this embodiment of the invention, thereby applying this embodiment to a variety of different types of rotating control heads. A hydraulic control 210 provides fluid to the rotating control head 200. The hydraulic control 210 typically includes a reservoir 215 to contain a supply of fluid, a pump 220 to communicate the fluid from the reservoir 215 to the rotating control head 200 and a valve 225 to remove excess pressure in the rotating control head 200.

Generally, the hydraulic control 210 provides fluid to energize a bladder 230 and lubricate a plurality of bearings 255. As the fluid enters a port 235, the fluid is communicated to the plurality of bearings 255 and a chamber 240. As the chamber 240 fills with a fluid, pressure P1 is created. The pressure P1 acts against the bladder 230 causing the bladder 230 to expand radially inward to seal around a tubular string (not shown). Typically, the pressure P1 is maintained between 0-200 psi above a wellbore pressure P2.

The rotating control head 200 is cooled by the heat exchanger 205. The heat exchanger 205 is constructed and arranged to remove heat from the rotating control head 200 by introducing a gas, such as air, at a low temperature into an inlet 265 and thereafter transferring heat energy from a plurality of seals 275 and the plurality of bearings 255 to the gas as the gas passes through the heat exchanger 205. Subsequently, the gas at a higher temperature exits the heat exchanger 205 through an outlet 270. Typically, gas is pumped into the inlet 265 by a blowing apparatus (not shown). However, other means of communicating gas to the inlet 265 may be employed, so long as they are capable of supplying a sufficient amount of gas to the heat exchanger 205.

FIG. 2B illustrates a schematic view of the heat exchanger 205. As illustrated, the heat exchanger 205 comprises a passageway 280 with a plurality of substantially square curves. The passageway 280 is arranged to maximize the surface area covered by the heat exchanger 205. The low temperature gas entering the inlet 265 flows through the passageway 280 in the direction illustrated by arrow 285. As the gas circulates through the passageway 280, the gas increases in temperature as the heat from the rotating control head 200 is transferred to the gas. The high temperature gas exits the outlet 270 as indicated by the direction of arrow 285. In this manner, the heat generated by the rotating control head 200 is transferred to the gas passing through the heat exchanger 205.

FIG. 3A illustrates a rotating control head 300 cooled by a gas. As shown, the rotating control head 300 is depicted generally to illustrate this embodiment of the invention, thereby applying this embodiment to a variety of different types of rotating control heads. A hydraulic control 310 supplies fluid to the rotating control head 300. The hydraulic control 310 typically includes a reservoir 315 to contain a supply of fluid and a pump 320 to communicate the fluid from the reservoir 315 to the rotating control head 300. Additionally, the hydraulic control 310 includes a valve 345 to relieve excess pressure in the rotating control head 300.

Generally, the hydraulic control 310 supplies fluid to energize a bladder 330 and lubricate a plurality of bearings 355. As the fluid enters a port 335, a portion is communicated to the plurality of bearings 355 and another portion is used to fill a chamber 340. As the chamber 340 fills with a fluid, a pressure P1 is created. Pressure P1 acts against the bladder 330 causing the bladder 330 to move radially inward to seal around a tubular string (not shown). Typically, the pressure P1 is maintained between 0 to 200 psi above a wellbore pressure P2. If the wellbore pressure P2 drops, the pressure P1 may be relieved through valve 345 by removing a portion of the fluid from the chamber 340.

The rotating control head 300 is cooled by a flow of gas through a substantially circular passageway 380 through an upper portion of the rotating control head 300. The circular passageway 380 is constructed and arranged to remove heat from the rotating control head 300 by introducing a gas, such as air, at a low temperature into an inlet 365, transferring heat energy to the gas and subsequently allowing the gas at a high temperature to exit through an outlet 370. The heat energy is transferred from a plurality of seals 375 and the plurality of bearings 355 as the gas passes through the circular passageway 380. Typically, gas is pumped into the inlet 365 by a blowing apparatus (not shown). However, other means of communicating gas to the inlet 365 may be employed, so long as they are capable of supplying a sufficient amount of gas to the substantially circular passageway 380.

FIG. 3B illustrates a schematic view of the gas passing through the substantially circular passageway 380. The circular passageway 380 is arranged to maximize the surface area covered by the circular passageway 380. The low temperature gas entering the inlet 365 flows through the circular passageway 380 in the direction illustrated by arrow 385. As the gas circulates through the circular passageway 380, the gas increases in temperature as the heat from the rotating control head 300 is transferred to the gas. The high temperature gas exits the outlet 370 as indicated by the direction of arrow 385. In this manner, the heat generated by the rotating control head 300 is removed allowing the rotating control head 300 to function properly.

In an alternative embodiment, the rotating control head 300 may operate without the use of the circular passageway 380. In other words, the rotating control head 300 would function properly without removing heat from the plurality of seals 375 and the plurality of bearings 355. This embodiment typically applies when the wellbore pressure P2 is relatively low.

FIGS. 4A and 4B illustrate a rotating control head 400 cooled by a fluid mixture. As shown, the rotating control head 400 is depicted generally to illustrate this embodiment of the invention, thereby applying this embodiment to a variety of different types of rotating control heads. A hydraulic control 410 supplies fluid to the rotating control head 400. The hydraulic control 410 typically includes a reservoir 415 to contain a supply of fluid and a pump 420 to communicate the fluid from the reservoir 415 to the rotating control head 400. Additionally, the hydraulic control 410 includes a valve 445 to relieve excess pressure in the rotating control head 400. In the same manner as the hydraulic control 310, the hydraulic control 410 supplies fluid to energize a bladder 430 and lubricate a plurality of bearings 455.

The rotating control head 400 is cooled by a fluid mixture circulated through a substantially circular passageway 480 on an upper portion of the rotating control head 400. In the embodiment shown, the fluid mixture preferably consists of water or a water-glycol mixture. However, other mixtures of fluid may be employed, so long as, the fluid mixture has the capability to circulate through the circular passageway 480 and reduce the heat in the rotating control head 400.

The circular passageway 480 is constructed and arranged to remove heat from the rotating control head 400 by introducing the fluid mixture at a low temperature into an inlet 465, transferring heat energy to the fluid mixture and subsequently allowing the fluid mixture at a high temperature to exit through an outlet 470. The heat energy is transferred from a plurality of seals 475 and the plurality of bearings 455 as the fluid mixture circulates through the circular passageway 480. The fluid mixture is preferably pumped into the inlet 465 through a fluid circuit 425. The fluid circuit 425 is comprised of a reservoir 490 to contain a supply of the fluid mixture and a pump 495 to circulate the fluid mixture through the rotating control head 400.

FIG. 4B illustrates a schematic view of the fluid mixture circulating in the substantially circular passageway 480. The circular passageway 480 is arranged to maximize the surface area covered by the circular passageway 480. The low temperature fluid entering the inlet 465 flows through the circular passageway 480 in the direction illustrated by arrow 485. As the fluid circulates through the circular passageway 480, the fluid increases in temperature as the heat from the rotating control head 400 is transferred to the fluid. The high temperature fluid exits out the outlet 470 as indicated by the direction of arrow 485. In this manner, the heat generated by the rotating control head 400 is removed allowing the rotating control head 400 to function properly.

FIGS. 5A and 5B illustrate a rotating control head 500 cooled by a refrigerant. As shown, the rotating control head 500 is depicted generally to illustrate this embodiment of the invention, thereby applying this embodiment to a variety of different types of rotating control heads. A hydraulic control 510 supplies fluid to the rotating control head 500. The hydraulic control 510 typically includes a reservoir 515 to contain a supply of fluid and a pump 520 to communicate the fluid from the reservoir 515 to the rotating control head 500. Additionally, the hydraulic control 510 includes a valve 545 to relieve excess pressure in the rotating control head 500. In the same manner as the hydraulic control 310, the hydraulic control 510 supplies fluid to energize a bladder 530 and lubricate a plurality of bearings 555.

The rotating control head 500 is cooled by a refrigerant circulated through a substantially circular passageway 580 in an upper portion of the rotating control head 500. The circular passageway 580 is constructed and arranged to remove heat from the rotating control head 500 by introducing the refrigerant at a low temperature into an inlet 565, transferring heat energy to the refrigerant and subsequently allowing the refrigerant at a high temperature to exit through an outlet 570. The heat energy is transferred from a plurality of seals 575 and the plurality of bearings 555 as the refrigerant circulates through the circular passageway 580. The refrigerant is preferably communicated into the inlet 565 through a refrigerant circuit 525. The refrigerant circuit 525 includes a reservoir 590 containing a supply of vapor refrigerant. A compressor 595 draws the vapor refrigerant from the reservoir 590 and compresses the vapor refrigerant into a liquid refrigerant. Thereafter, the liquid refrigerant is communicated to an expansion valve 560. At this point, the expansion valve 560 changes the low temperature liquid refrigerant into a low temperature vapor refrigerant as the refrigerant enters inlet 565.

FIG. 5B illustrates a schematic view of the vapor refrigerant circulating in the substantially circular passageway 580. The circular passageway 580 is arranged in an approximately 320-degree arc to maximize the surface area covered by the circular passageway 580. The low temperature vapor refrigerant entering the inlet 565 flows through the circular passageway 580 in the direction illustrated by arrow 585. As the vapor refrigerant circulates through the circular passageway 580, the vapor refrigerant increases in temperature as the heat from the rotating control head 500 is transferred to the vapor refrigerant. The high temperature vapor refrigerant exits out the outlet 570 as indicated by the direction of arrow 585. Thereafter, the high temperature vapor refrigerant rejects the heat to the environment through a heat exchanger (not shown) and returns to the reservoir 590. In this manner, the heat generated by the rotating control head 500 is removed allowing the rotating control head 500 to function properly.

Figure 6:
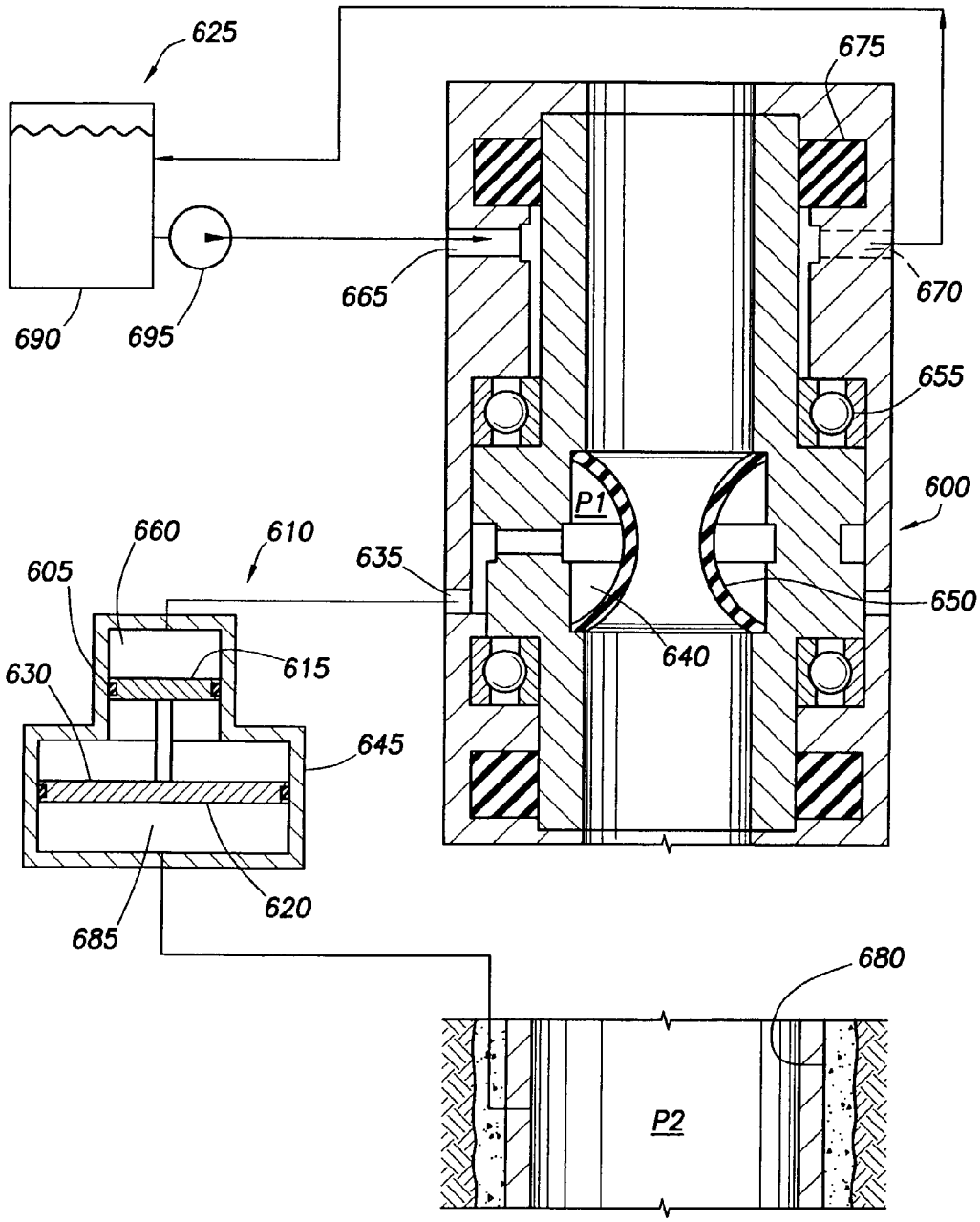
FIG. 6 illustrates a rotating control head actuated by a piston intensifier in communication with the wellbore pressure.
Figure 7B:
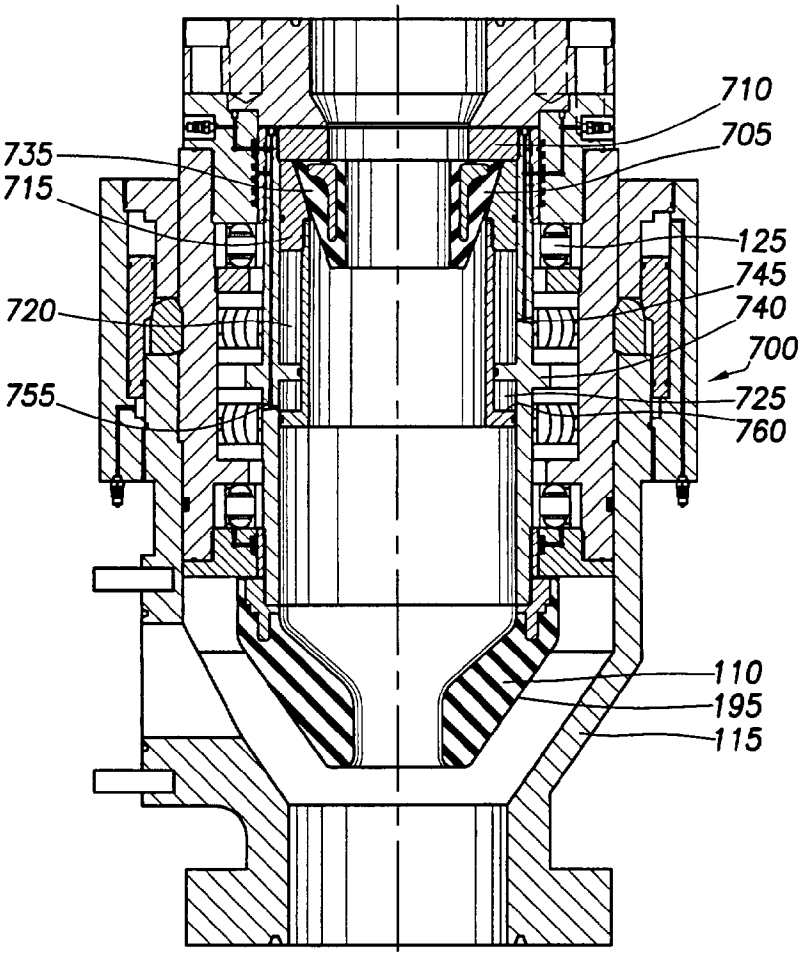
FIG. 7B illustrates the rotating control head in a locked position.

FIG. 6 illustrates a rotating control head 600 actuated by a piston intensifier circuit 610 in communication with a wellbore 680. As shown, the rotating control head 600 is depicted generally to illustrate this embodiment of the invention, thereby applying this embodiment to a variety of different types of rotating control heads. The piston intensifier circuit 610 supplies fluid to the rotating control head 600. The piston intensifier circuit 610 typically includes a housing 645 and a piston arrangement 630. The piston arrangement 630 is formed from a larger piston 620 and a smaller piston 615. The pistons 615, 620 are constructed and arranged to maintain a pressure differential between a hydraulic pressure P1 and a wellbore pressure P2. In other words, the pistons 615, 620 are designed with a specific surface area ratio to maintain about a 200 psi pressure differential between the hydraulic pressure P1 and the wellbore pressure P2, thereby allowing the P1 to be 200 psi higher than P2. The piston arrangement 630 is disposed in the housing 645 to form an upper chamber 660 and lower chamber 685. Additionally, a plurality of seal members 605 are disposed around the pistons 615, 620 to form a fluid tight seal between the chambers 660, 685.

The piston intensifier circuit 610 mechanically provides hydraulic pressure P1 to energize a bladder 650. Initially, fluid is filled into upper chamber 660 and is thereafter sealed. The wellbore fluid from the wellbore 680 is in fluid communication with lower chamber 685. Therefore, as the wellbore pressure P2 increases more wellbore fluid is communicated to the lower chamber 685 creating a pressure in the lower chamber 685. The pressure in the lower chamber 685 causes the piston arrangement 630 to move axially upward forcing fluid in the upper chamber 660 to enter port 635 and pressurize a chamber 640. As the chamber 640 fills with a fluid, the pressure P1 increases causing the bladder 650 to move radially inward to seal around a tubular string (not shown). In this manner, the bladder 650 is energized allowing the rotating control head 600 to seal around a tubular.

A fluid, such as water-glycol, is circulated through the rotating control head 600 by a fluid circuit 625. Typically, heat on the rotating control head 600 is removed by introducing the fluid at a low temperature into an inlet 665, transferring heat energy to the fluid and subsequently allowing the fluid at a high temperature to exit through an outlet 670. The heat energy is transferred from a plurality of seals 675 and the plurality of bearings 655 as the fluid circulates through the rotating control head 600. The fluid is preferably pumped into the inlet 665 through the fluid circuit 625. Generally, the circuit 625 comprises a reservoir 690 to contain a supply of the fluid and a pump 695 to circulate the fluid through the rotating control head 600.

In another embodiment, the piston intensifier circuit 610 is in fluid communication with a nitrogen gas source (not shown). In this embodiment, a pressure transducer (not shown) measures the wellbore pressure P2 and subsequently injects nitrogen into the lower chamber 685 at the same pressure as pressure P2. The nitrogen pressure in the lower chamber 685 may be adjusted as the wellbore pressure P2 changes, thereby maintaining the desired pressure differential between hydraulic pressure P1 and wellbore pressure P2.

Figure 7A:
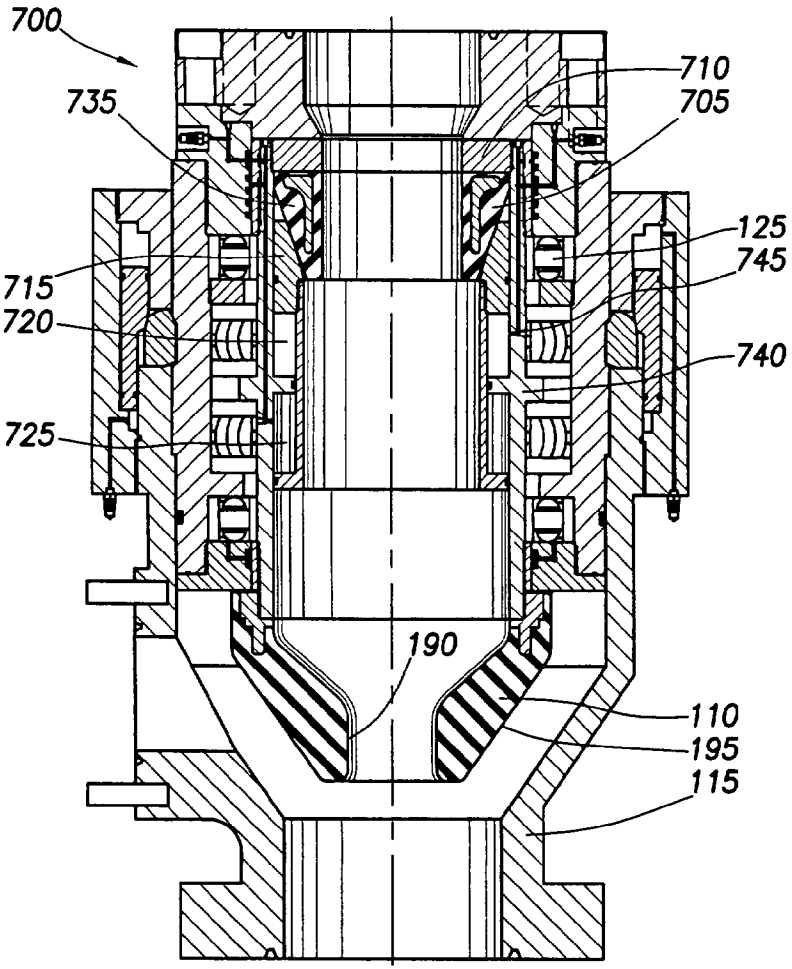
FIG. 7A illustrates an alternative embodiment of a rotating control head in an unlocked position.
Figure 8:
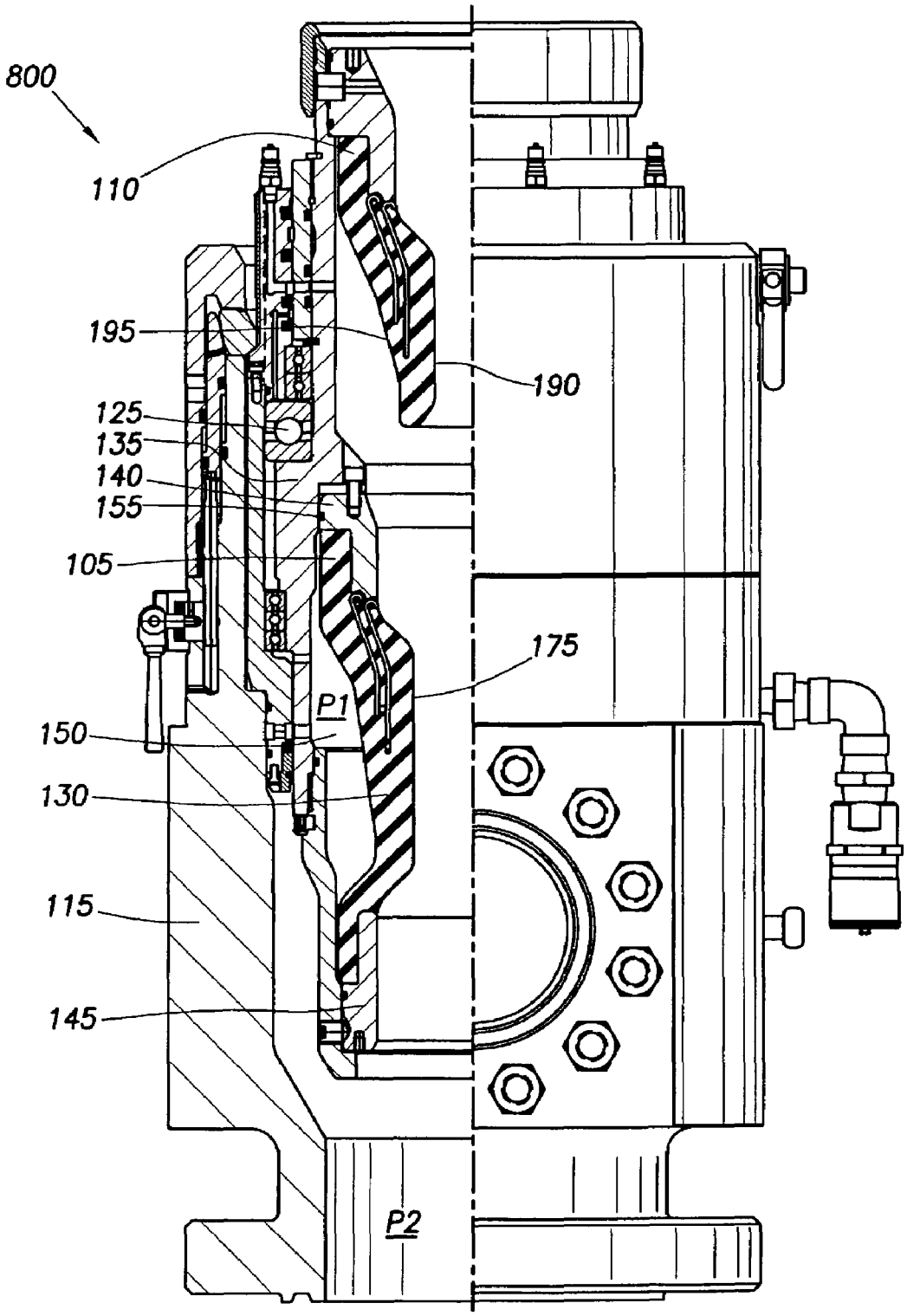
FIG. 8 illustrates an alternative embodiment of a rotating control head in accord with the present invention.

FIG. 7A illustrates an alternative embodiment of a rotating control head 700 in an unlocked position. The rotating control head 700 is arranged and constructed in a similar manner as the rotating control head 100 shown on FIG. 1. Therefore, for convenience, similar components that function in the same manner will be labeled with the same numbers as the rotating control head 100. The primary difference between the rotating control head 700 and rotating control head 100 is the active seal assembly.

As shown in FIG. 7A, the rotating control head 700 includes an active seal assembly 705. The active seal assembly 705 includes a primary seal 735 that moves radially inward as a piston 715 wedges against a tapered surface of the seal 735. The primary seal 735 is constructed from flexible material to permit sealing around irregularly shaped tubular string such as a hexagonal kelly. The upper end of the seal 735 is connected to a top ring 710.

The active sealing assembly 705 includes an upper chamber 720 and a lower chamber 725. The upper chamber 720 is formed between the piston 715 and a piston housing 740. To move the rotating control head 700 from an unlocked position to a locked position, fluid is pumped through port 745 into an upper chamber 720. As fluid fills the upper chamber 720, the pressure created acts against the lower end of the piston 715 and urges the piston 715 axially upward until it reaches the top ring 710. At the same time, the piston 715 wedges against the tapered portion of the primary seal 735 causing the seal 735 to move radially inward to seal against the tubular string. In this manner, the active seal assembly 705 is in the locked position as illustrated in FIG. 7B.

As shown on FIG. 7B, the piston 715 has moved axially upward contacting the top ring 710 and the primary seal 735 has moved radially inward. To move the active seal assembly 705 from the locked position to the unlocked position, fluid is pumped through port 755 into the lower chamber 725. As the chamber fills up, the fluid creates a pressure that acts against surface 760 to urge the piston 715 axially downward, thereby allowing the primary seal 735 to move radially outward as shown on FIG. 7A.

FIG. 8 illustrates an alternative embodiment of a rotating control head 800 in accord with the present invention. The rotating control head 800 is constructed from similar components as the rotating control head 100 shown on FIG. 1. Therefore, for convenience, similar components that function in the same manner will be labeled with the same numbers as the rotating control head 100. The primary difference between the rotating control head 800 and rotating control head 100 is the location of the active seal assembly 105 and the passive seal assembly 110.

As shown on FIG. 8, the passive seal assembly 110 is disposed above the active seal assembly 105. The passive seal assembly 110 is operatively attached to the bladder support housing 135, thereby allowing the passive seal assembly 110 to rotate with the active seal assembly 105. The passive seal assembly 110 is constructed and arranged in an axially downward conical shape, thereby allowing the pressure in the rotating control head 800 to act against the tapered surface 195 and close the passive seal assembly 110 around the tubular. Additionally, the passive seal assembly 110 includes the inner diameter 190, which is smaller than the outer diameter of the tubular to allow an interference fit between the tubular and the passive seal assembly 110.

As depicted, the active seal assembly 105 includes the bladder support housing 135 mounted on the plurality of bearings 125. The bladder support housing 135 is used to mount bladder 130. Under hydraulic pressure, bladder 130 moves radially inward to seal around a tubular such as a drilling tubular. Generally, fluid is supplied to the chamber 150 under a controlled pressure to energize the bladder 130. Essentially, a hydraulic control (not shown) maintains and monitors hydraulic pressure within pressure chamber 150. Hydraulic pressure P1 is preferably maintained by the hydraulic control between 0 to 200 psi above a wellbore pressure P2. The bladder 130 is constructed from flexible material allowing bladder surface 175 to press against the tubular at approximately the same pressure as the hydraulic pressure P1.

The hydraulic control may be used to de-energize the bladder 130 and allow the active seal assembly 105 to release the seal around the tubular. Generally, the fluid in the chamber 150 is drained into a hydraulic reservoir (not shown), thereby reducing the pressure P1. Subsequently, the bladder surface 175 loses contact with the tubular as the bladder 130 becomes de-energized and moves radially outward. In this manner, the seal around the tubular is released allowing the tubular to be from the rotating control head 800.

While the foregoing is directed to embodiments of the present invention, other and further embodiments of the invention may be devised without departing from the basic scope thereof, and the scope thereof is determined by the claims that follow.

What is claimed is:

1. A drilling system, comprising:

a rotating control head for sealing a tubular string while permitting axial movement of the string relative to the rotating control head;

a heat exchanger formed around a circumference of the rotating control head, wherein the heat exchanger comprises a surface including a plurality of abutments positioned circumferentially about the surface for increasing a surface area of the circumference;

a cooling medium for passing through a pathway formed by the surface to remove heat from the rotating control head; and a hydraulic control for supplying a fluid to the rotating control head.

2. The system of claim 1, further including a fluid circuit.

3. The system of claim 1, wherein the cooling medium comprises a gas.

4. The system of claim 1, wherein the cooling medium comprises a refrigerant.

5. The system of claim 1, wherein the cooling medium comprises a fluid.

6. The system of claim 5, wherein the fluid is a water-glycol mixture.

7. The system of claim 1, wherein the rotating control head includes an active seal for sealing around the tubular string.

8. The system of claim 1, wherein the rotating control head includes a passive seal for sealing around the tubular string.

9. The system of claim 1, wherein a passive seal is disposed above an active seal.

10. The system of claim 1, wherein an active seal is disposed above a passive seal.

11. The system of claim 1, wherein the plurality of abutments comprises a tortuous path through the rotating control head.

12. A drilling system, comprising:

a rotating control head for sealing a tubular string while permitting axial movement of the string relative to the rotating control head;

an actuating fluid for actuating the rotating control head and maintaining a pressure differential between the actuating fluid and a wellbore fluid; and a piston arrangement having a first piston in fluid communication with the actuating fluid and a second larger piston in fluid communication with the wellbore fluid, wherein the piston arrangement uses a pressure in the wellbore fluid to mechanically increase the hydraulic pressure of the actuating fluid relative to the wellbore fluid.

13. The system of claim 12, further including an actuating fluid circuit having a pump to supply fluid from a reservoir.

14. The system of claim 13, wherein the actuating circuit includes a valve member to release excess fluid from the rotating control head when the wellbore pressure drops below the pressure in the rotating control head.

15. The system of claim 12, wherein a fluid fills a chamber to urge a bladder radially inward to seal off the tubular string.

16. The system of claim 12, wherein a fluid fills a first chamber causing the piston arrangement to move in a first direction to act against a seal assembly, thereby urging the seal assembly radially inward to seal around the tubular string.

17. The system of claim 16, wherein the fluid fills a second chamber causing the piston to move in a second direction, thereby allowing the seal assembly to move radially outward releasing the seal around the tubular string.

18. The system of claim 12, wherein the hydraulic pressure is maintained between 0 and 200 psi above the wellbore pressure.

19. The system of claim 12, wherein the piston arrangement is disposed in a housing.

20. The system of claim 12, wherein the first piston and the second larger piston are constructed and arranged with a surface area ratio permitting a greater pressure in the rotating control head than the wellbore pressure.

21. The system of claim 20, whereby the wellbore pressure acts on the second larger piston causing the piston arrangement to move axially upward permitting the first piston to pressurize a chamber and activate the rotating control head.

22. The system of claim 12, further including a cooling medium for passing through the rotating control head.

23. The system of claim 22, wherein the rotating control head includes a heat exchanger in fluid communication with the cooling medium.

24. The system of claim 23, wherein the heat exchanger includes a tortuous path formed therein.

25. The system of claim 22, wherein the rotating control head includes a substantially circumferential pathway in fluid communication with a fluid circuit to provide a pathway for the cooling medium.

26. The system of claim 22, wherein the cooling medium is a water-glycol mixture.

27. The system of claim 22, wherein the cooling medium is a gas.

28. A rotating control head, comprising:

a sealing member for sealing a tubular string while permitting axial movement of the string relative to the rotating control head;

an actuating fluid for actuating the rotating control head and maintaining a pressure differential between the actuating fluid and a wellbore fluid; and a piston arrangement in fluid communication with the actuating fluid and the wellbore fluid, wherein the piston arrangement uses a pressure in the wellbore fluid to mechanically increase the hydraulic pressure of the actuating fluid relative to the wellbore fluid to energize the sealing member and the piston arrangement is disposed in a housing, the piston arrangement includes a smaller piston operatively connected to a larger piston.

29. The rotating control head of claim 28, wherein a fluid fills a chamber to urge a bladder radially inward to seal off the tubular string.

30. The rotating control head of claim 28, wherein a fluid fills a first chamber causing a piston to move in a first direction to act against seal assembly, thereby urging the seal assembly radially inward to seal around the tubular string.

31. The rotating control head of claim 30 wherein the fluid fills a second chamber causing the piston to move in a second direction, thereby allowing the seal assembly to move radially outward releasing the seal around the tubular string.

32. The rotating control head of claim 28, wherein the smaller piston and the larger piston are constructed and arranged with a surface area ratio permitting a greater pressure in the rotating control head than the wellbore pressure.

33. The rotating control head of claim 32, wherein the larger piston is in fluid communication with the wellbore pressure, whereby the wellbore pressure acts on the larger piston causing the piston arrangement to move axially upward permitting the smaller piston to pressurize a chamber and activate the rotating control head.

34. The rotating control head of claim 28, further including a fluid circuit including a cooling medium for passing through the rotating control head.

35. The rotating control head of claim 34, wherein the rotating control head includes a heat exchanger in fluid communication with the fluid circuit to provide a pathway for the cooling medium.

36. The rotating control head of claim 34, wherein the rotating control head includes a substantially circular pathway in fluid communication with the fluid circuit to provide a pathway for the cooling medium.

37. The rotating control head of claim 34, wherein the cooling medium is a water-glycol mixture.

38. The rotating control head of claim 34, wherein the cooling medium is a gas.

39. The rotating control head of claim 28, wherein the rotating control head includes an active seal for sealing around the tubular string.

40. The rotating control head of claim 28, wherein the rotating control head includes a passive seal for sealing around the tubular string.

41. The rotating control head of claim 28, wherein a passive seal is disposed above an active seal.

42. The rotating control head of claim 28, wherein an active seal is disposed above a passive seat.

43. A drilling system, comprising:

a rotating control head for sealing a tubular string while permitting axial movement of the string relative to the rotating control head;

a water-glycol mixture for passing through a substantially circumferential pathway formed in the rotating control head, wherein the circumferential pathway comprises a surface including a plurality of abutments positioned circumferentially about the surface for increasing a surface area of the circumferential pathway; and an actuating fluid for actuating the rotating control head and maintaining a pressure differential between a fluid pressure in the rotating control head and wellbore pressure.

44. A method for sealing a tubular in a rotating control head, comprising:

supplying fluid to the rotating control head;

activating a seal arrangement, thereby creating a seal around the tubular;

passing a cooling medium through the rotating control head; and maintaining a pressure differential between a pressure in the rotating control head and wellbore pressure by utilizing the wellbore acting on a mechanical device including at least two pistons having different surface areas.

45. The method of claim 44, wherein the rotating control head includes a heat exchanger in communication with a fluid circuit to provide a fluid pathway for the cooling medium.

46. The method of claim 45, wherein the heat exchanger comprises a substantially circumferential pathway in communication with the cooling medium.

47. The system of claim 44, wherein the cooling medium is a water-glycol mixture.

48. The system of claim 44, wherein the cooling medium is a gas.

49. A drilling system, comprising:

a rotating control head for sealing a tubular string while permitting axial movement of the string relative to the rotating control head;

a gas for passing through a substantially circular pathway formed in the rotating control head to remove heat therefrom; and a fluid for activating the rotating control head and for lubricating a plurality of bearings in the rotating control head and a fluid control for supplying the fluid to the rotating control head.

* * * * *

UNITED STATES PATENT AND TRADEMARK OFFICE

CERTIFICATE OF CORRECTION

PATENT NO. : 7,040,394 B2
APPLICATION NO. : 10/285336
DATED : May 9, 2006
INVENTOR(S) : Thomas F. Bailey et al.

It is certified that error appears in the above-identified patent and that said Letters Patent is hereby corrected as shown below:

In column 12, line 43, please delete [seat] and insert --seal--.

Signed and Sealed this

Seventeenth Day of October, 2006

JON W. DUDAS
*Director of the United States Patent and Trademark Office*